US005646673A

United States Patent [19]

Kodama

[11] Patent Number: 5,646,673

[45] Date of Patent: Jul. 8, 1997

[54] EXPOSURE DEVICE

[75] Inventor: Kenichi Kodama, Kanagawa, Japan

[73] Assignee: Fuji Photo Film Co., Ltd., Kanagawa, Japan

[21] Appl. No.: 398,793

[22] Filed: Mar. 6, 1995

[30] Foreign Application Priority Data

Mar. 15, 1994 [JP] Japan ..... 6-044363

[51] Int. Cl.[6] ..... B41J 2/47

[52] U.S. Cl. ..... 347/251

[58] Field of Search ..... 347/251, 259, 347/260

[56] References Cited

U.S. PATENT DOCUMENTS 4,032,888 6/1977 Broyles et al. ..... 347/260

4,786,919 11/1988 Bidner et al. ..... 347/259

OTHER PUBLICATIONS

"Periodic image artifacts from continuous-tone laser scanners" *Applied Optics*, vol. 25 No. 21, Paul C. Schubert, 1986, pp. 3880–3884.

*Primary Examiner*—Mark J. Reinhart

*Attorney, Agent, or Firm*—Sughrue, Mion, Zinn, Macpeak & Seas

[57] ABSTRACT

An exposure device. While a photosensitive material is being moved such that a subscanning interval is L, a polygon mirror rotates at rotational speed $f_p$, and due to this rotation, a light beam is deflected in a main scanning direction and is main-scanned. A material and a configuration of an SOS mirror are set so that a natural frequency $f_m$ thereof is not a value which is an integer multiple of the rotational speed $f_p$. An SOS sensor outputs a timing signal when a light beam, which is reflected from the SOS mirror and which corresponds to a vicinity of a start-of-main-scan point, is incident on the SOS sensor. Based on the signal, a control device controls a light source such that the light beam is main-scanned from the start-of-main-scan point. An imaging optical system images, on the photosensitive material, the light beam deflected by the polygon mirror. Because the natural frequency $f_m$ of the SOS mirror is not a value near an integer multiple of the frequency $f_p$, a beat is not generated between the rotational speed $f_p$ of the polygon mirror and the natural frequency $f_m$ of the SOS mirror. Therefore, when the light beam, which is reflected from the SOS mirror and which corresponds to a vicinity of the start-of-main-scan point, is incident on the SOS sensor, the SOS sensor outputs the timing signal appropriately.

14 Claims, 6 Drawing Sheets

EXPOSURE DEVICE

BACKGROUND OF THE INVENTION

1. Field of the Invention

The present invention relates to an exposure device, and more particularly, to an exposure device in which a light beam emitted from a light source is main-scanned, and the light beam and a photosensitive material to be exposed are moved relative to one another such that sub-scanning is effected, and the photosensitive material is exposed.

2. Description of the Related Art

In an exposure device which scans/exposes a photosensitive material by using a deflector such as a polygon mirror or the like, the light emitting timing and the intensity of the emitted light of a semiconductor laser are controlled so as to correspond to the information or image to be recorded. While the light beam which is emitted from the semiconductor laser is deflected in the main scanning direction by the polygon mirror, the light beam exposes the photosensitive material so that information is recorded or an image is formed.

In such an exposure device, a photosensitive material is exposed from a start-of-main-scan point on the photosensitive material, i.e., from the point of the first exposure on the photosensitive material (the start of writing point), by using an SOS (start of scan) mirror and an SOS sensor. Namely, a light beam corresponding to a point outside of the image region on the photosensitive material is reflected at the SOS mirror and is incident on the SOS sensor. At this time, the SOS sensor outputs a predetermined signal to a microcomputer. The microcomputer to which the signal is input controls the light emitting timing of the semiconductor laser on the basis of the inputted signal, and the photosensitive material is exposed from the start of writing point in the main scanning direction on the photosensitive material.

However, because the polygon mirror in the above-described exposure device rotates at high speed, high frequency vibration is generated. A beat is generated due to the high frequency vibration of the polygon mirror and due to the natural vibration of the SOS mirror. The timing of the light beam reflected from the SOS mirror and incident on the SOS sensor deviates, and fluctuations (jitters) occur in the output timing of the signal outputted by the SOS sensor when the light beam is incident thereon. As a result, the start-of-main-scan point on the photosensitive material (the point of first exposure onto the photosensitive material) deviates. When the first exposure point deviates, irregularities in density in the subscanning direction are generated in the image recorded on the photosensitive material due to the multiple exposure effect of the photosensitive material. A drawback arises in that an image of appropriate image quality cannot be formed.

Further, due to the beat caused by the high frequency vibration of the polygon mirror and the natural vibration of the SOS mirror, the above-mentioned jitter fluctuates periodically. Accordingly, due to the periodic fluctuations of the jitter, the position at which writing of information onto the photosensitive material starts deviates periodically. When the start of writing position deviates periodically, for example, in a case in which the amount of jitter is large, the pixel positions, become disordered, and in a case in which the amount of jitter is small, the pixel positions are aligned. The disarray of the pixel positions and alignment of the pixel positions also occurs periodically. When this occurs, due to the multiple exposure effect of the photosensitive material, the image density when the pixel positions are aligned and the image density when the pixel positions are disordered are respectively different. As a result, a drawback arises in that irregularities in image density in the subscanning direction are generated periodically in the image recorded on the photosensitive material, and an image of the appropriate image quality cannot be formed.

SUMMARY OF THE INVENTION

In view of the aforementioned, an object of the present invention is to provide an exposure device in which irregularities in image density in the subscanning direction in an image recorded on a photosensitive material can be prevented so that an image of appropriate image quality can be formed.

A first aspect of the present invention is an exposure device comprising: a light source which emits a light beam; main scanning means for main scanning the light beam emitted from the light source by deflecting the light beam in a main scanning direction, the main scanning means vibrating at a frequency $f_p$; imaging means for imaging, on a photosensitive material, the light beam deflected by the main scanning means; subscanning means for moving the light beam and the photosensitive material relative to one another to subscan the light beam such that a subscanning interval is L; reflecting means for reflecting a light beam which is deflected by the main scanning means and which corresponds to a point outside of an image region on the photosensitive material, a natural frequency of the reflecting means being $f_m$; signal outputting means for outputting a predetermined signal when the light beam reflected from the reflecting means is incident on the signal outputting means; and light source control means for controlling the light source on the basis of the signal such that the light beam is main-scanned from a start-of-main-scan point, wherein at least one of the frequency $f_p$, the natural frequency $f_m$, and the subscanning interval L is set such that one of the following first condition and second condition is satisfied:

first condition:

$$n'f_p-C1<f_m<n'f_p+C1$$

second condition:

$$n'f_p+C2<f_m \text{ when } f_m \geqq n'f_p$$

$$n'f_p-C2>f_m \text{ when } f_m<n'f_p$$

wherein $\alpha 1$ is a minimum value of spatial frequencies in a region in which image light-to-dark contrast is visible, the image light-to-dark contrast being generated on the photosensitive material by vibration of the main scanning means and natural vibration of the reflecting means, the region in which the image light-to-dark contrast is visible being obtained from a visibility curve which expresses a relation between spatial frequencies of the image light-to-dark contrast and density differences of the image light-to-dark contrast; $\alpha 2$ is a maximum value of the spatial frequencies in the region in which the image light-to-dark contrast is visible; C1 is a value determined by the minimum value $\alpha 1$, the frequency $f_p$, and the subscanning interval L; C2 is a value determined by the maximum value $\alpha 2$, the frequency $f_p$, and the subscanning interval L; and n is an integer.

A second aspect of the present invention is an exposure device comprising: a light source which emits a light beam; main scanning means for main scanning the light beam emitted from the light source by deflecting the light beam in a main scanning direction, the main scanning means vibrating at a frequency $f_p$; imaging means for imaging, on a photosensitive material, the light beam deflected by the main scanning means; subscanning means for moving the light beam and the photosensitive material relative to one another to subscan the light beam such that a subscanning interval is L; reflecting means for reflecting a light beam which is deflected by the main scanning means and which corresponds to a point outside of an image region on the photosensitive material, a natural frequency of the reflecting means being $f_m$; signal outputting means for outputting a predetermined signal when the light beam reflected from the reflecting means is incident on the signal outputting means; and light source control means for controlling the light source on the basis of the signal such that the light beam is main-scanned from a start-of-main-scan point, wherein at least one of the frequency $f_p$, the natural frequency $f_m$, and the subscanning interval L is set so that a spatial frequency A of image light-to-dark contrast on a photosensitive material, which image light-to-dark contrast is caused by vibration of the main scanning means and natural vibration of the reflecting means and which spatial frequency A is obtained from following formula (1) in which n is an integer, is one of a value which is less than a minimum value of spatial frequencies of a region in which image light-to-dark contrast on the photosensitive material is visible, the image light-to-dark contrast being caused by vibration of the main scanning means and natural vibration of the reflecting means, the region in which the image light-to-dark contrast is visible being obtained from a visibility curve which expresses a relation between spatial frequencies of the image light-to-dark contrast and density differences of the image light-to-dark contrast, and a value greater than a maximum value of the spatial frequencies of the region in which image light-to-dark contrast on the photosensitive material is visible.

$$A=|f_m-n\cdot f_p|/(L'f_p) \quad (1)$$

In the first aspect of the present invention, the main scanning means, which vibrates at a frequency $f_p$, main-scans a light beam emitted from the light source by deflecting the light beam in the main scanning direction. The subscanning means moves the light beam and a photosensitive material relative to one another such that the subscanning interval is L. The reflecting means having a natural frequency of $f_m$ reflects a light beam which is deflected by the main scanning means and which corresponds to a point outside of the image region on the photosensitive material. The signal outputting means outputs a predetermined signal when the light beam reflected from the reflecting means is incident on the signal outputting means. The light source control means controls the light source on the basis of the signal such that the light beam is main-scanned from the start-of-main-scan point. The imaging means images, on the photosensitive material, the light beam scanned by the main scanning means.

At least one of the frequency $f_p$, the natural frequency $f_m$, and the subscanning interval L is set such that either the above-mentioned first condition or the above-mentioned second condition is satisfied, wherein α1 is a minimum value of spatial frequencies in a region in which image light-to-dark contrast is visible, the image light-to-dark contrast being generated on the photosensitive material by vibration of the main scanning means and natural vibration of the reflecting means, the region in which the image light-to-dark contrast is visible being obtained from a visibility curve which expresses a relation between spatial frequencies of the image light-to-dark contrast and density differences of the image light-to-dark contrast; α2 is a maximum value of the spatial frequencies in the region in which the image light-to-dark contrast is visible; C1 is a value determined by the minimum value α1, the subscanning interval L, and the frequency $f_p$; C2 is a value determined by the maximum value α2, the subscanning interval L, and the frequency $f_p$; and n is an integer.

Here, the distance which the main scan line moves in the subscanning direction per unit time is $L'f_p$.

Further, given that the frequency of the main scanning means caused by the rotation of the main scanning means at a rotational speed of $f_p$ is $f_p$, and that the natural frequency of the reflecting means is $f_m$, the frequency Δf of the beat caused by the vibration of the main scanning means and the natural vibration of the reflecting means is obtained by the following formula (2).

$$\Delta f=|f_m-n'f_p| \quad (2)$$

Accordingly, given that the spatial frequency, which is the number of times the image light-to-dark contrast appears per unit length on the photosensitive material due to the beat, is $f_s$, the following relational expression (3) is established.

$$f_s=\frac{\Delta f}{L\cdot f_p} \quad (3)$$

As illustrated in FIG. 6, from the visibility curve which expresses the relation between, on the one hand, spatial frequencies of the image light-to-dark contrast which is generated on the photosensitive material due to the vibration of the main scanning means and the natural vibration of the reflecting means and, on the other hand, density differences of the image light-to-dark contrast, if the density difference is d and the spatial frequency $f_s$ is greater than or equal to α1 and less than or equal to α2, image irregularities can be perceived on the photosensitive material. Namely, in region R1 illustrated in FIG. 6, because the frequency of the image light-to-dark contrast on the photosensitive material is small, image irregularities cannot be perceived if the density difference of the image light-to-dark contrast is not large. Further, in region R3 as well, because the frequency of the image light-to-dark contrast on the photosensitive material is large, the image irregularities cannot be perceived if the density difference of the image light-to-dark contrast is not large. However, in region R2, it is easy to perceive the spatial frequency of the image light-to-dark contrast on the photosensitive material relative to the density difference of the image light-to-dark contrast. Accordingly, when the spatial frequency $f_s$ is either smaller than the spatial frequency α1 which is the border between region R1 and region R2 (i.e., the minimum value of the spatial frequencies of region R2 in which image light-to-dark contrast can be seen, which minimum value is obtained from the visibility curve), or greater than the spatial frequency α2 which is the border between region R2 and region R3 (i.e., the maximum value of the spatial frequencies of the region R2 in which the image light-to-dark contrast can be seen, which maximum value is obtained from the visibility curve), image irregularities are not perceived on the photosensitive material. Therefore, following relational expressions (4) and (5) are established from formulae (2) and (3).

$$\frac{|f_m-n\cdot f_p|}{L\cdot f_p}<\alpha 1 \quad (4)$$

$$\frac{|f_m-n\cdot f_p|}{L\cdot f_p}<\alpha 2 \quad (5)$$

If formula (4) is deformed, following formula (6) is obtained. If formula (5) is deformed, following formula (7)

is obtained when $f_m \geqq n'f_p$, and following formula (8) is obtained when $f_m < n'f_p$.

$$n \cdot f_p - \alpha 1 \cdot L \cdot f_p < f_m < n \cdot f_p + \alpha 1 \cdot L \cdot f_p \quad (6)$$

$$n \cdot f_p + \alpha 2 \cdot L \cdot f_p < f_m \quad (7)$$

$$n \cdot f_p - \alpha 2 \cdot L \cdot f_p > f_m \quad (8)$$

Accordingly, in the first aspect, at least one of the frequency $f_p$, the natural frequency $f_m$, and the subscanning interval L is set so that either the first condition (corresponding to formula (6)) or the second condition (corresponding to formulae (7) and (8)) is satisfied. As a result, the occurrence of a heat between the vibration of the main scanning means and the natural vibration of the reflecting means can be prevented, and the signal outputting means appropriately outputs the predetermined signal to the light control means. Accordingly, exposure can begin reliably from the start-of-main-scan point on the photosensitive material.

In the second aspect, at least one of the frequency $f_p$, the natural frequency $f_m$, and the subscanning interval L is set so that a spatial frequency A of image light-to-dark contrast on a photosensitive material, which image light-to-dark contrast is caused by vibration of the main scanning means and natural vibration of the reflecting means and which spatial frequency A is obtained from above formula (1) (corresponding to above formula (3)), is one of: a value which is less than a minimum value (corresponding to $\alpha 1$) of spatial frequencies of a region R2 (see FIG. 6) in which image light-to-dark contrast on the photosensitive material is visible, the image light-to-dark contrast being caused by vibration of the main scanning means and natural vibration of the reflecting means, the region in which the image light-to-dark contrast is visible being obtained from a visibility curve which expresses a relation between spatial frequencies of the image light-to-dark contrast and density differences of the image light-to-dark contrast; and a value greater than a maximum value (corresponding to a $\alpha 2$) of the spatial frequencies of the region R2 in which image light-to-dark contrast on the photosensitive material is visible.

As a result, formula (4) or formula (5) is satisfied, and image irregularities are not perceived in the image on the photosensitive material.

In a case in which the main scanning means is structured so as to include a polygon mirror having a number $n_p$ of reflecting surfaces and rotating at a rotational speed $f_p$, the distance which the main scanning line proceeds in the subscanning direction per unit time is $L'n_p'f_p$. Therefore, the denominator in formula (3) is $L'n_p'f_p$. Accordingly, the respective denominators of formulae (4) and (5) are also $L'n_p'f_p$. Formulae (6) through (8) thereby become following formulae (9) through (11).

$$n'f_p - \alpha 1'L'n_p'f_p < f_m < n'f_p + \alpha 1'L'n_p'f_p \quad (9)$$

$$n'f_p + \alpha 2'L'n_p'f_p < f_m \quad (10)$$

$$n'f_p - \alpha 2'L'n_p'f_p > f_m \quad (11)$$

DESCRIPTION OF THE PREFERRED EMBODIMENT

Figure 1:
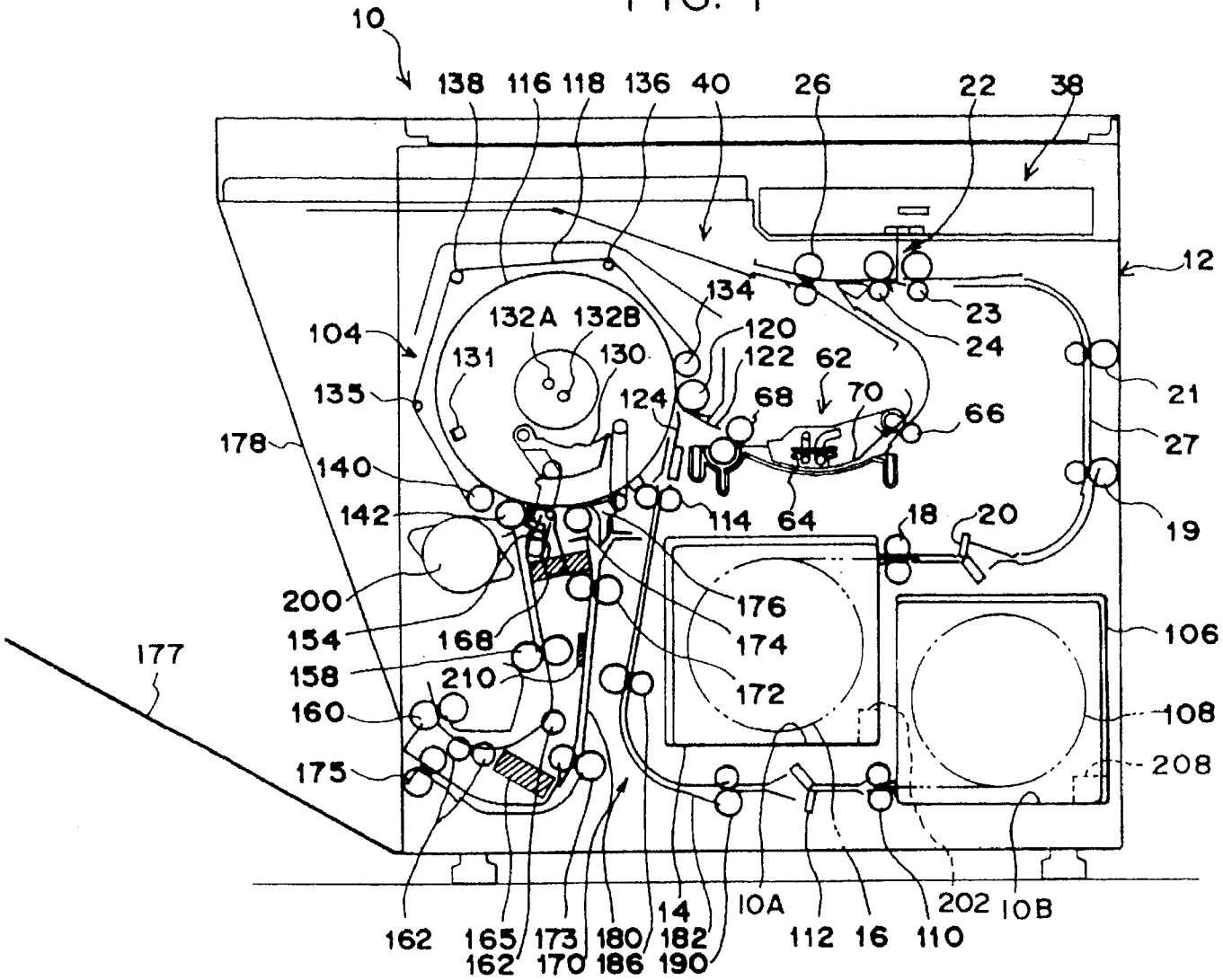
FIG. 1 is a schematic overall structural view of an image recording device in which an exposure device of the present invention is housed.
Figure 2:
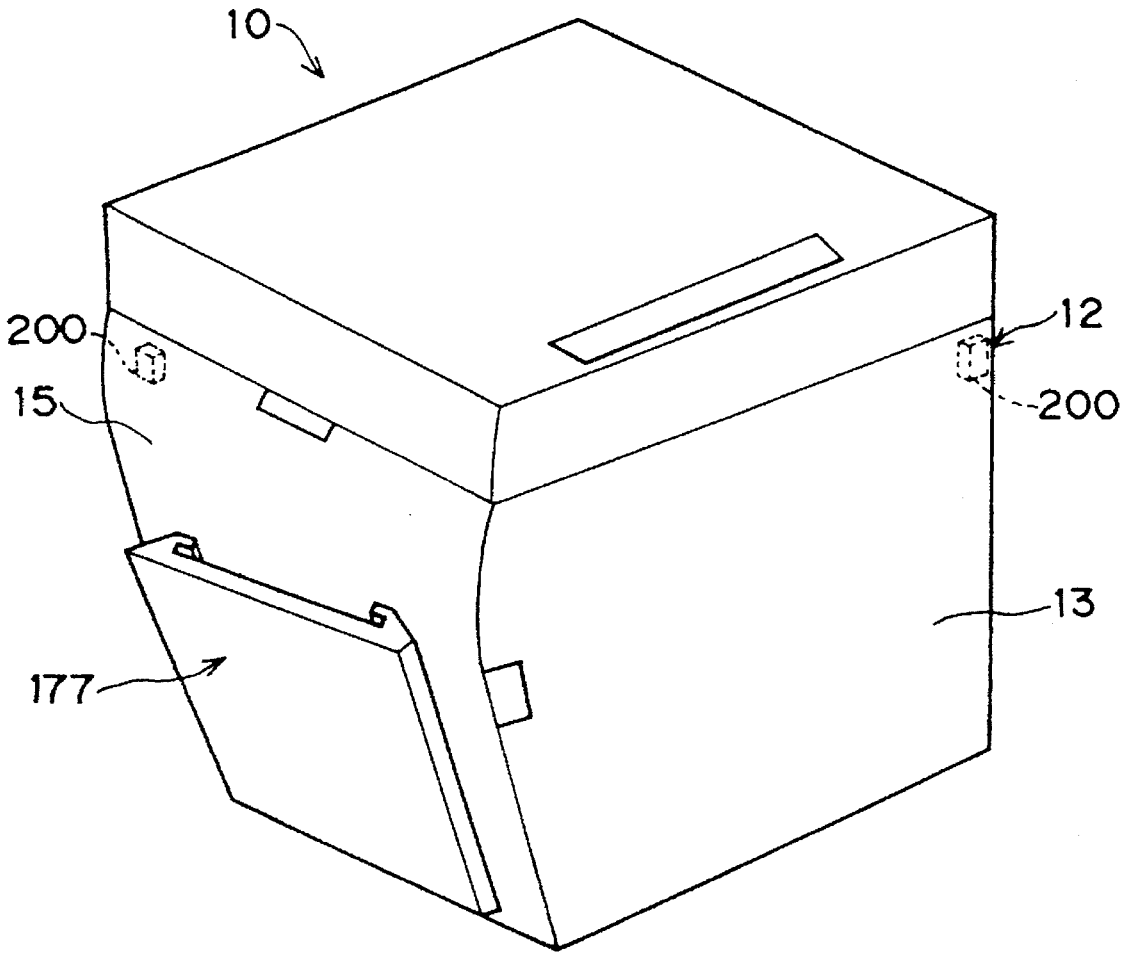
FIG. 2 is a perspective view illustrating an exterior of the image recording device of the present embodiment.

Hereinafter, an embodiment of the present invention will be described in detail with reference to the drawings. FIG. 1 is a schematic overall structural view of an image recording device 10 in which an exposure device 38 of the present embodiment is housed. FIG. 2 illustrates the exterior of the image recording device 10.

As illustrated in FIG. 2, the image recording device 10 is on the whole formed in a box shape. Front surface door 13 and side surface door 15 are attached to a machine stand 12. By opening these doors, the interior of the machine stand 12 is exposed.

As shown in FIG. 1, a photosensitive material magazine 14 is disposed within the machine stand 12 of the image recording device 10. A photosensitive material 16 wound in roll form is accommodated within the photosensitive material magazine 14. The photosensitive material 16 is wound such that the photosensitive surface (exposure surface) thereof faces toward the bottom of the device when the photosensitive material 16 is first pulled out from the photosensitive material magazine 14.

An indicia (e.g., a mark, a notch, a protrusion or the like) corresponding to the type of photosensitive material 16 accommodated within the photosensitive material magazine 14 is provided on the photosensitive material magazine 14. A photosensitive material detecting sensor 202 which detects this indicia is attached to a loading portion 10A, and is connected to a control device 206. Due to the signal from the photosensitive material detecting sensor 202, it can be determined whether the photosensitive material magazine 14 has been loaded, and the type and lot of a photosensitive material 16 accommodated in the photosensitive material magazine 14 can also be determined.

Nip rollers 18 and a cutter 20 are disposed in a vicinity of the opening of the photosensitive material magazine 14 from which the photosensitive material 16 is withdrawn. After a predetermined length of the photosensitive material 16 has been pulled out from the photosensitive material magazine 14, the photosensitive material 16 is cut.

A plurality of conveying rollers 19, 21, 23, 24, 26 and guide plates 27 are disposed next to the cutter 20 and convey the photosensitive material 16, which has been cut to the predetermined length, to an exposure section 22.

The exposure section 22 is disposed between the conveying rollers 23 and the conveying rollers 24. The space between these conveying rollers is the exposure portion (exposure point), and the photosensitive material 16 passes thereby (subscanning).

Figure 3:
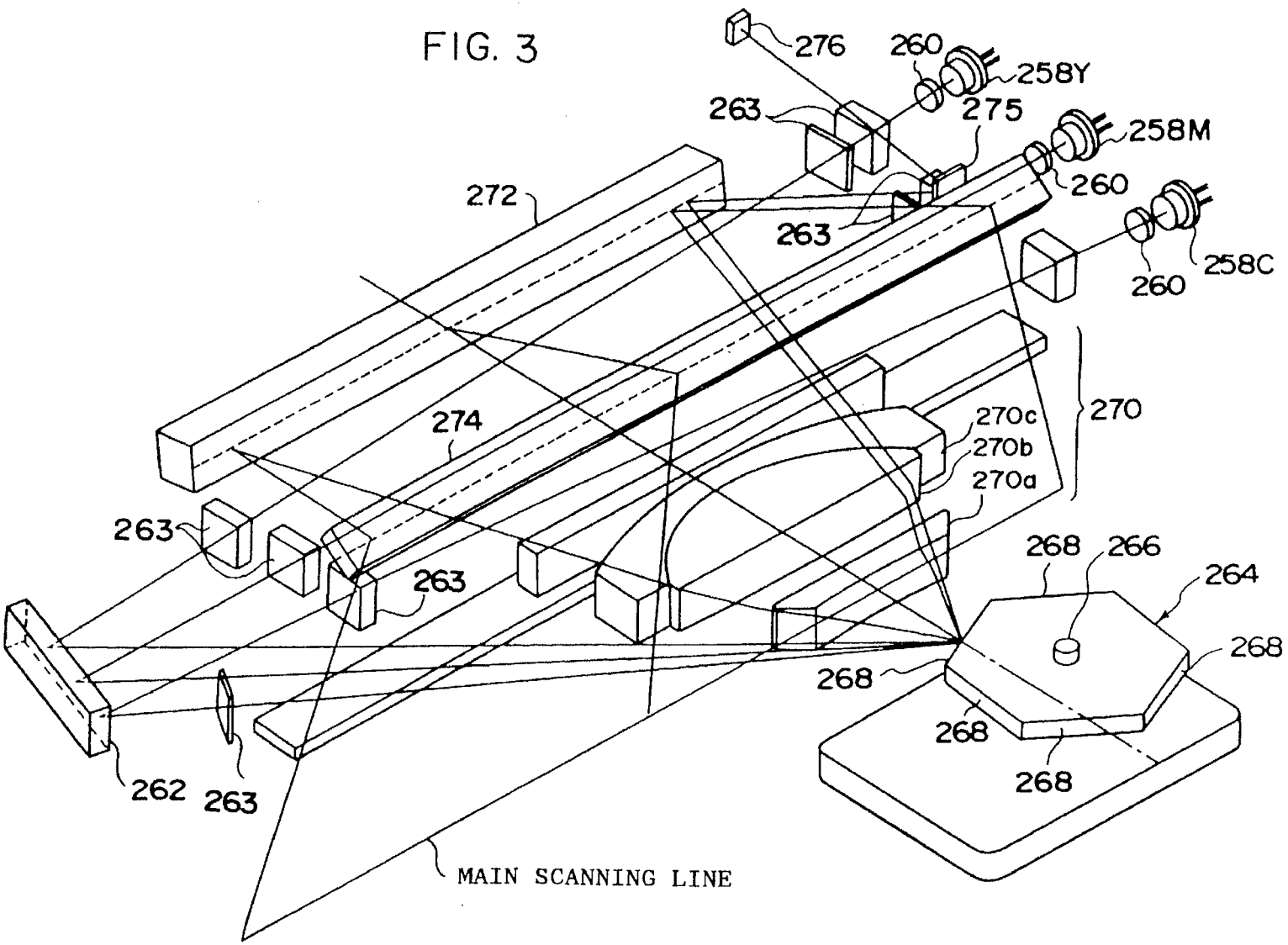
FIG. 3 is a schematic perspective view of the exposure device.
Figure 4:
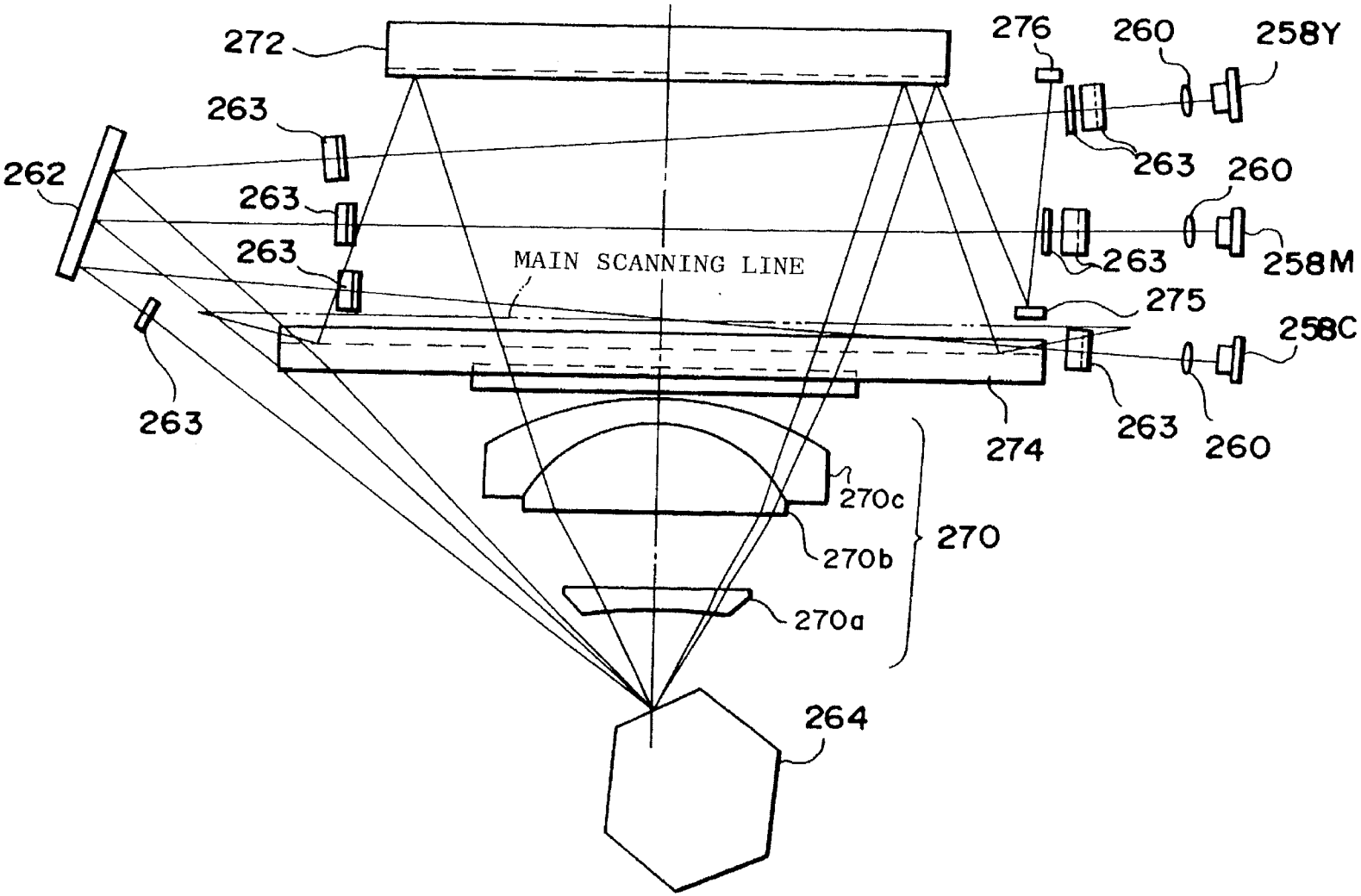
FIG. 4 is a schematic view of the exposure device as viewed from above.

An exposure device 38 is disposed directly above the exposure section 22. As illustrated in FIGS. 3 and 4, semiconductor lasers 258C, 258M, 258Y, which serve as C (cyan), M (magenta) and Y (yellow) light sources, are disposed in the exposure device 38. Collimator lenses 260 are respectively disposed in vicinities of the light exiting sides of the semiconductors lasers 258C, 258M, 258Y. The collimator lenses 260 make the light beams irradiated from the semiconductor lasers 258C, 258M, 258Y into parallel light. The respective light beams which have been made into parallel light at the collimator lenses 260 pass through cylindrical lenses 263, are incident on a reflecting mirror 262, are reflected by the reflecting mirror 262, are combined, and are made incident on a polygon mirror 264 serving as a main scanning means. The cylindrical lenses 263 serve to correct the tilt of the surfaces of the polygon mirror 264. The number $n_p$ of reflecting surfaces of the polygon mirror 264 which reflect the incident light beam is six (i.e., the polygon mirror 264 has six reflecting mirrors 268).

The polygon mirror 264 rotates at high speed around a shaft 266, and serves to continuously vary and deflect the angle of incidence of the light beam upon the reflecting mirrors 268 (main scanning). In the present embodiment, the rotational speed of the polygon mirror 264 is 125 rps.

The light beam which is main-scanned by the polygon mirror 264 passes through an imaging optical system 270, which serves as an imaging means and includes an Fθ lens formed by a concavo-plano lens 270*a*, a plano-convex lens 270*b*, and a concavo-convex lens 270*c*. The light beam is then reflected by reflecting mirrors 272, 274 and reaches the exposure section 22. The reflecting mirror 274 is tilted at a predetermined angle so as to reflect downward the light beam reflected from the reflecting mirror 272.

An SOS (start of scan) mirror 275 serving as a reflecting means is provided next to the reflecting mirror 274. The light beam reflected by the polygon mirror 264 is first illuminated to the SOS mirror 275. The light beam first illuminated (i.e., the light beam corresponding to a vicinity of the start-of-main-scan point) is reflected at the SOS mirror 275, and is made incident on an SOS sensor 276 which serves as a signal outputting means. The SOS sensor 276 outputs a predetermined signal when the light beam from the SOS mirror 275 is incident thereon. The signal outputted from the SOS sensor 276 is used as the start signal of an image signal of one main scan, and is synchronous with the start of each main scan.

The exposure section 22 is structured such that, while the photosensitive material 16 is being subscanned, the main scan of the light beam is repeated so that one image is recorded.

The control of the exposure amount is effected by changing the pulse widths of the pulse signals outputted from the respective semiconductor lasers 258C, 258M, 258Y (pulse width modulation). Namely, in accordance with the number of pixels of one main scan, the outputs from the semiconductor lasers 258C, 258M, 258Y are set in advance to predetermined frequencies ($f_0$), and the pulses thereof are made to correspond respectively to the pixels. By changing the pulse width for each pulse, the amount of exposure of each pixel can be controlled. This amount of exposure is calculated on the basis of the image signal inputted to the control device 206.

In the present embodiment, the natural frequency $f_m$ of the SOS mirror 275 is set in the following manner so that a beat is not generated due to the vibration of the polygon mirror 264 and the natural vibration of the SOS mirror 275, and no image irregularities in the subscanning direction are perceived on the image recorded on the photosensitive material 16.

Figure 6:
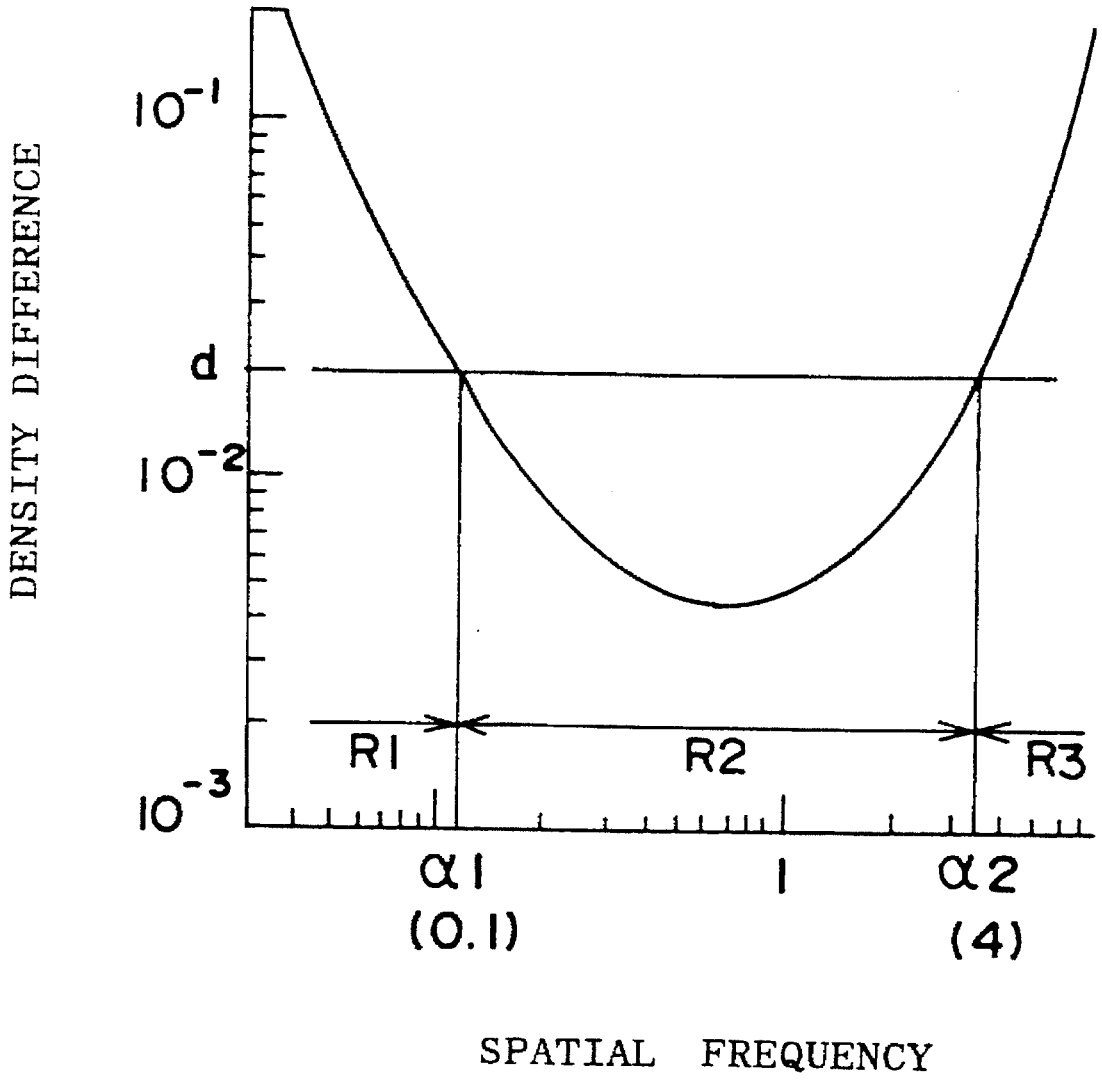
FIG. 6 is a diagrammatic view illustrating a relation between, on the one hand, image density differences of image light-to-dark contrast based on image irregularities and, on the other hand, spatial frequencies of image light-to-dark contrast based on image irregularities appearing on a photosensitive material.

The polygon mirror 264 is rotated at a high speed at a rotational speed $f_p$ of 125 rps. Accordingly, the polygon mirror 264 generates a vibration of 125 Hz. Further, when the subscanning interval L is $1.6\times10^{-2}$ mm and the image density difference d of the image irregularities is 0.02, α1 is 0.1 (cycles/mm) and α2 is 4 (cycles/mm) as illustrated in FIG. 6.

Accordingly, if the natural frequency $f_m$ is within the range of formula (12) or formulae (18) and (14) which are derived from formulae (9) through (11), image irregularities cannot be perceived on the image recorded on the photosensitive material.

$$125n-1.2<f_m21\ 1.2+125n \quad (12)$$

$$125n+48<f_m \text{ in a case in which } f_m \geqq n'f_p \quad (13)$$

$$125n-48>f_m \text{ in a case in which } f_m<n'f_p \quad (14)$$

In other words, in accordance with formula (12) or formulae (13) and (14), if the natural frequency $f_m$ of the SOS mirror 275 does not become a value near a value which is an integer multiple of the rotational speed $f_p$ of the polygon mirror 264, image irregularities are not perceived on the image recorded on the photosensitive material.

Here, if the integer n is 6, from formulae (12) through (14), the natural frequency $f_m$ of the SOS mirror 275 is a value which is greater than 748.8 Hz and less than 751.2 Hz (from formula (12)), or is a value which is either greater than 798 Hz (from formula (13)) or a value which is less than 702 Hz (from formula (14)). Further, when the integer n is 7, from formulae (12) through (14), the natural frequency $f_m$ of the SOS mirror 275 is a value which is greater than 873.8 Hz and less than 876.2 Hz (from formula (12)), or is a value which is either greater than 923 Hz (from formula (13)) or a value which is less than 827 Hz (from formula (14)). Accordingly, in the present embodiment, the material for and the configuration of the SOS mirror 275 are selected so that the natural frequency $f_m$ is a value which is greater than 798 Hz and less than 827 Hz.

As illustrated in FIG. 1, a switch back section 40 is provided next to the exposure section 22. Further, a water application section 62 is provided beneath the exposure section 22. The photosensitive material 16, which was conveyed upwardly at the side of the photosensitive material magazine 14 and which was exposed at the exposure section 22, is delivered temporarily into the switch back section 40. Thereafter, the conveying rollers 26 are rotated reversely so that the photosensitive material 16 is delivered into the water applying section 62 via a conveying path provided under the exposure section 22. A plurality of pipes are connected to the water applying section 62, and water is supplied via these pipes.

A heat developing transfer section 104 is disposed next to the water applying section 62. The photosensitive material 16, to which water has been applied, is sent into the heat developing transfer section 104.

A receiving material magazine 106 is provided next to the photosensitive material magazine 14 in the machine stand 12. An image receiving material 108 wound in roll form is accommodated within the receiving material magazine 106. A dye fixing material having mordant is applied to the image forming surface of the image receiving material 108. The image receiving material 108 is wound such that the image forming surface thereof is oriented toward the top of the device when the image receiving material 108 is first pulled out of the receiving material magazine 106.

In the same way as the photosensitive material magazine 14, the receiving material magazine 106 is structured from a drum portion and a pair of side frame portions which are fixed to the end portions of the drum portion. The receiving material magazine 106 can be pulled out from the front surface side of the machine stand 12 (from the side illustrated in FIG. 1, i.e., the transverse direction of the wound image receiving material 108).

An indicia (e.g., a mark, a notch, a protrusion), which corresponds to the type of the image receiving material 108 accommodated in the receiving material magazine 106, is provided on the receiving material magazine 106. Further, a receiving material detecting sensor 208 which detects this indicia is attached to the loading section 10B, and is connected to the control device 206. Due to the signal from the receiving material detecting sensor 208, it can be determined whether the receiving material magazine 106 has been loaded, and the type and lot of an image receiving material 108 accommodated in the receiving material magazine 106 can also be determined.

Nip rollers 110 are disposed in a vicinity of the opening of the receiving material magazine 106 from which the image receiving material 108 is withdrawn. The nip rollers 110 can pull the image receiving material 108 out from the receiving material magazine 106, and the nipping thereof can be released. A cutter 112 is disposed next to the nip rollers 110.

An image receiving material conveying section 170 is provided next to the cutter 112 and next to the photosensitive material magazine 14. Conveying rollers 186, 190, 114 and guide plates 182 are disposed in the image receiving material conveying section 170, and can convey the image receiving material 108, which has been cut to a predetermined length, to the heat developing transfer section 104.

The photosensitive material 16 conveyed to the heat developing transfer section 104 is delivered between a laminating roller 120 and a heat drum 116. Synchronously with the conveying of the photosensitive material 16, the image receiving material 108 is conveyed between the laminating roller 120 and the heat drum 116 in a state in which the photosensitive material 16 precedes the image receiving material 108 by a predetermined length, and the photosensitive material 16 and the image receiving material 108 are superposed.

A pair of halogen lamps 132A, 132B are disposed at the interior portion of the heat drum 116. The temperature of the surface of the heat drum 116 can be raised by the halogen lamps 132A, 132B.

An endless press-contact belt 118 is trained around five training rollers 134, 135, 136, 138, 140. The endless press-contact belt 118 between the training roller 134 and the training roller 140 press-contacts the outer periphery of the heat drum 116.

A bending/guiding roller 142 is disposed at the lower portion of the heat drum 116 at the downstream side in the material supplying direction of the endless belt 118. At the lower portion of the heat drum 116 at the downstream side of the bending/guiding roller 142 in the material supplying direction, a peeling claw 154 is axially supported by a shaft so as to be pivotable.

The photosensitive material 16 peeled by the peeling claw 154 is trained around the bending/guiding roller 142 and is discharged into a waste photosensitive material accommodating box 178 so as to be accumulated.

A peeling roller 174 and a peeling claw 176 are disposed next to the bending/guiding roller 142 in a vicinity of the heat drum 116. Receiving material guides 180 as well as receiving material discharge rollers 172, 173, 175 are provided under the peeling roller 174 and the peeling claw 176, and can guide and convey the image receiving material 108 which has been peeled from the heat drum 116 by the peeling roller 174 and the peeling claw 176.

The image receiving material 108, which has been peeled from the outer periphery of the heat drum 116 by the peeling claw 176, is conveyed by the receiving material guides 180 and the receiving material discharge rollers 172, 173, 175, and is discharged into a tray 177.

Figure 5:
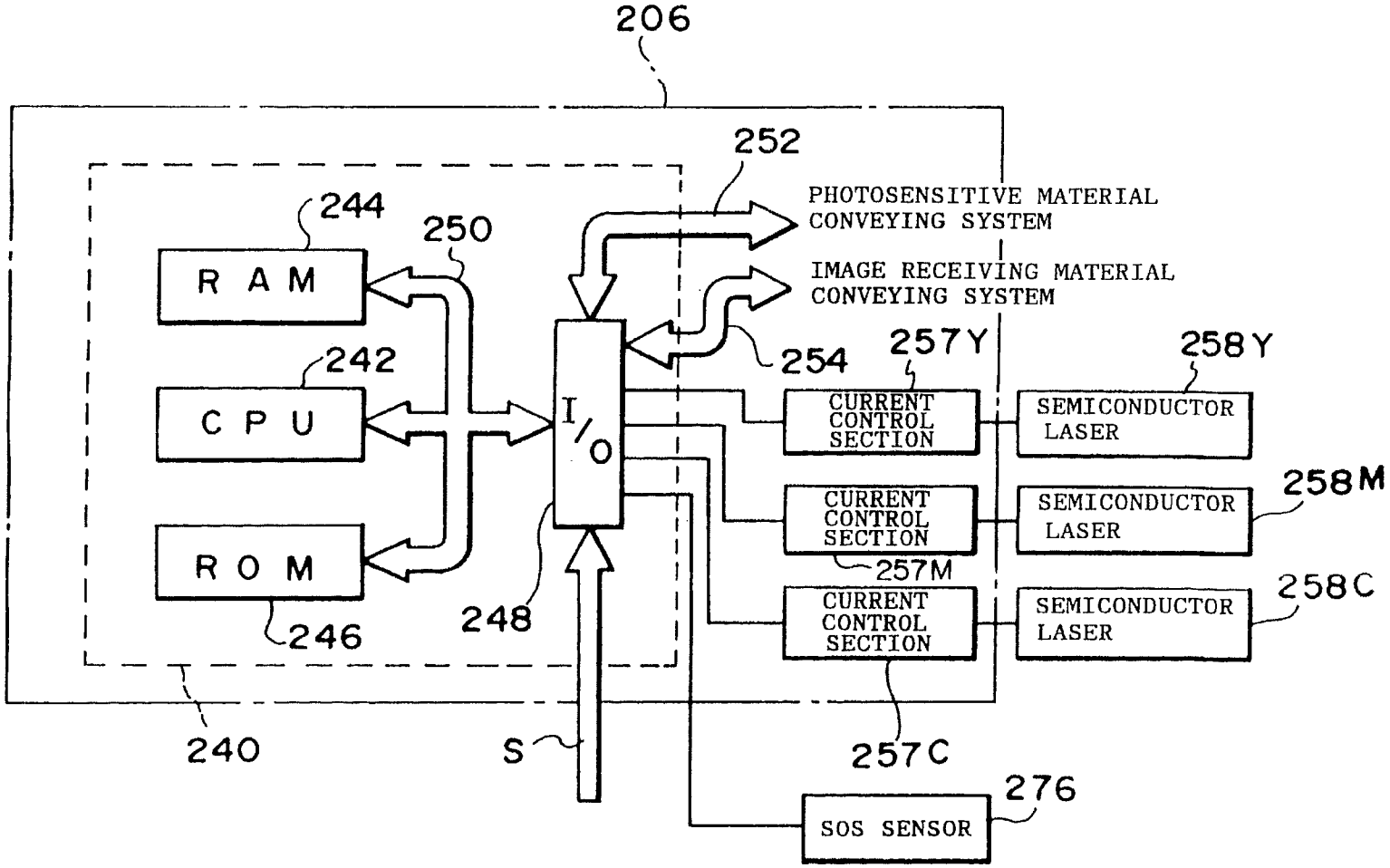
FIG. 5 is a control block diagram.

As illustrated in FIG. 5, the control device 206 includes a microcomputer 240. The microcomputer 240 is structured by a CPU 242, a RAM 244, a ROM 246, an input/output port 248 and busses 250 such as data busses and control busses which connect these elements.

An image signal S (e.g., a video signal or the like) which is the basis for the image to be recorded is input to the input/output port 248. Further, signal wires 252, 254 to a photosensitive material conveying system and to an image receiving material conveying system are connected to the input/output port 248, so that the microcomputer 240 controls the driving of the respective driving sections and controls the conveying of the photosensitive material and the image receiving material. Moreover, the SOS sensor 276 is connected to the input/output port 248. Current control. sections 257Y, 257M, 257C, which control the light emitting timing and the intensity of the emitted light of the semiconductor lasers 258Y, 258M, 258C, are also connected to the input/output port 248.

Next, operation of the present embodiment will be described. First, when instructions are given to start processing, the nip rollers 18 are operated while the photosensitive material magazine 14 is in a set state, so that the photosensitive material 16 is pulled out by the nip rollers 18. When a predetermined length of the photosensitive material 16 has been pulled out, the cutter 20 is operated so that the photosensitive material 16 is cut to the predetermined length.

After the cutter 20 is operated, the photosensitive material 16 is reversed, and is conveyed to the exposure section 22 in a state in which its photosensitive surface (exposure surface) faces upward. The exposure section 38 is activated simultaneously with the conveying of the photosensitive material 16, and the photosensitive material 16 positioned at the exposure section 22 is scanned and exposed. Namely, the semiconductor lasers 258Y, 258M, 258C emit light, and the irradiated light beams are incident on the collimator lenses 260. For the light beams from the collimator lenses 260 which light beams have been made parallel, correction of the tilt of the surfaces of the polygon mirror 264 is effected by the cylindrical lenses 263. Then, the light beams are reflected by the reflecting mirror 262 and are incident on the polygon mirror 264 such that the respective optical axes thereof are combined at the polygon mirror 264 and the light beams are focussed at the reflecting mirror 268 of the polygon mirror 264.

The polygon mirror 264 has six reflecting mirrors 268, and the light beams are incident on the respective surfaces at a frequency of 750 Hz. Due to the rotation of the polygon mirror 264, the light beam is deflected in the main scanning direction. While being deflected in the main scanning direction, the light beam is incident on the Fθ lens having the predetermined imaging system formed by the concavo-plano lens **270*a*, the plano-convex lens 270*b*, and the concavo-convex lens 270*c*. At the reflecting mirror 272, the light beam is reflected vertically upward, and is then reflected vertically downward at the reflecting mirror 274. The light beam is imaged on the photosensitive material 16 so that the photosensitive material 16** is exposed.

The light beam which is deflected by the polygon mirror 64 is first illuminated onto and reflected by the SOS mirror 275, and is incident on the SOS sensor 276. The SOS sensor 276 outputs a predetermined signal when the beam reflected by the SOS mirror 275 is incident on the SOS sensor 276. The signal outputted from the SOS sensor 276 is used as the start signal of the image signal of one main scan, and is synchronous with the start of each main scan. The exposure of the photosensitive material 16 thereby begins from a predetermined position (start of writing position) of the main scanning direction of the photosensitive material 16. The pulse widths of the pulse signals outputted from the respective semiconductor lasers 258C, 258M, 258Y are changed so that the amount of exposure is the amount of exposure calculated on the basis of the image signal inputted from the control device 206, and the photosensitive material 16 is exposed as it is main-scanned. At the exposure section 22, while the photosensitive material 16 is being subscanned, the main scanning of the light beam is repeated so that the photosensitive material 16 is exposed and one image is recorded.

After exposure has been completed, the photosensitive material 16 is temporarily sent into the switch back section 40. Thereafter, the conveying rollers 26 are rotated reversely so that the photosensitive material 16 is fed into the water applying section 62.

In the water applying section 62, water is applied to the photosensitive material 16. Further, the photosensitive material 16 passes through the water applying section 62 while excess water is removed therefrom by squeeze rollers 68.

The photosensitive material 16, to which water serving as a solvent for image forming has been applied in the water applying section 62, is delivered into the heat developing transfer section 104 by the squeeze rollers 68.

As the scanning/exposing of the photosensitive material 16 begins, the image receiving material 108 is pulled out from the receiving material magazine 106 by the nip rollers 110 and is conveyed thereby. When a predetermined length of the image receiving material 108 has been pulled out, the cutter 112 is operated so as to cut the image receiving material 108 to the predetermined length.

After the cutter 112 is operated, the cut image receiving material 108 is conveyed by the conveying rollers 190, 186, 114 while being guided by the guide plates 182, and is held in a standby state immediately before the heat developing transfer section 104.

At the heat developing transfer section 104, when the delivery of the photosensitive material 16 between the outer periphery of the heat drum 116 and the laminating roller 120 by the squeeze rollers 68 is detected, the conveying of the image receiving material 108 is restarted so that the image receiving material 108 is delivered to the laminating roller 120, and also the heat drum 116 is activated.

A guide plate 122 is disposed between the laminating roller 120 and the squeeze rollers 68 of the water applying section 62. The photosensitive material 16 delivered from the squeeze rollers 68 is reliably guided to the laminating roller 120 by the guide plate 122.

The photosensitive material 16 and the image receiving material 108, which are superposed by the laminating roller 120, are nipped in a superposed state between the heat drum 116 and the endless pressure/contact belt 118, and are conveyed over approximately ⅔ of the periphery of the heat drum 116 (between the training roller 134 and the training roller 140). The photosensitive material 16 and the image receiving material 108 are thereby heated. Mobile dyes are released, and at the same time, the dyes are transferred to the dye fixing layer of the image receiving material 108 so that an image is obtained.

Thereafter, when the photosensitive material 16 and the image receiving material 108, which are nipped and conveyed, reach the bottom portion of the heat drum 116, the peeling claw 154 is moved by a cam 130. The peeling claw 154 engages the leading end portion of the photosensitive material 16 which is conveyed so as to precede the image receiving material 108 by a predetermined length, and the leading end portion of the photosensitive material 16 is peeled from the outer periphery of the heat drum 116. Due to the return movement of the peeling claw 154, a pinch roller 200 presses the photosensitive material 16. The photosensitive material 16 is thereby trained around the bending/guiding roller 142 while being pressed by the pinch roller 200, and is moved downward and accumulated in the waste photosensitive material accommodating box 178.

The image receiving material 108, which has been separated from the photosensitive material 16 and which moves while still fit closely to the heat drum 116, is sent to the peeling roller 174 and is peeled.

The image receiving material 108, which has been peeled from the outer periphery of the heat drum 116 by the peeling claw 176, is moved downwardly while trained around the peeling roller 174. The image receiving material 108 is conveyed by the receiving material discharge rollers 172, 173, 175 while being guided by the receiving material guides 180, and is discharged into the tray 177.

In the above-described embodiment, when the image density difference d is 0.02, $\alpha 1$ is 0.1 cycles/mm and $\alpha 2$ is 4 cycles/mm, $\alpha 1$ and $\alpha 2$ being obtained from the visibility curve. Therefore, the spatial frequency $f_s$ in which light-to-dark contrast based on image irregularities on the photosensitive material appears must be a value which is less than 0.1 cycles/mm or a value which is greater than 4 cycles/mm. Accordingly, in the present embodiment, the materials and the configuration of the SOS mirror are set such that, with $\alpha 2(=4)$ as a standard, the natural frequency $f_m$ of the SOS mirror is a value greater than 798 Hz (obtained from formula (13) corresponding to formula (10)) and is a value smaller than 827 Hz (obtained from formula (14) corresponding to formula (11)). In this way, the natural frequency $f_m$ of the SOS mirror is not a value which is close to six times or seven times the frequency $f_p$ of the polygon mirror. As a result, the occurrence of fluctuations in the SOS mirror due to vibration of the polygon mirror can be prevented, and the SOS sensor appropriately outputs the predetermined signal to the control device. Therefore, the light beam can be reliably illuminated from the predetermined position on the photosensitive material. The positions of the pixels are thereby aligned, and an appropriate image is formed.

In the above-described embodiment, $\alpha 2$ which is obtained from the visibility curve is used as a standard. However, the present invention is not limited to the same, and $\alpha 1$ (formula (12) corresponding to formula (9)) may be used as the standard. Further, although the image density difference d in the above description is 0.02, the present invention is not limited to the same and other values may be used as illustrated in FIG. 6.

Further, in the above embodiment, the natural frequency $f_m$ of the SOS mirror is not a value which is near six times or seven times the frequency $f_p$ of the polygon mirror. However, the present invention is not limited to the same, and other integer multiples may be used.

The SOS mirror reflects the light beam in a vicinity of the start-of-main-scan point on the photosensitive material. However, a light beam elsewhere outside of the image region on the photosensitive material may be reflected. Namely, a light beam in the vicinity of the point where main scanning ends on the photosensitive material, or a light beam which is outside of the image region and either on or off the photosensitive material may be reflected.

The natural frequency $f_m$ of the SOS mirror satisfies formulae (12), (13), (14) corresponding to formulae (9), (10), and (11). However, the present invention is not limited to the same. The rotational speed $f_p$ of the polygon mirror and the subscanning interval L may satisfy the formulae (12), (13), (14) corresponding to formulae (9), (10), and (11). Alternatively, the natural frequency $f_m$ of the SOS mirror, the rotational speed $f_p$ of the polygon mirror and the subscanning interval L may all satisfy the formulae (12), (13), (14) corresponding to formulae (9), (10), and (11).

Further, in the above embodiment, the SOS mirror and the SOS sensor are provided. However, the present invention is not limited to the same, and the light beam reflected by the polygon mirror may first be incident on the SOS sensor. In this case, the natural frequency $f_m$ of the SOS sensor satisfies formulae (12), (13), (14) corresponding to formulae (9), (10), and (11).

In the above-described embodiment, an example is given in which a polygon mirror which generates a frequency $f_p$ (i.e., which rotates at a rotational speed $f_p$) is used. However, the present invention is not limited to the same, and a mirror which moves reciprocally at the frequency $f_p$, e.g., a resonant scanner or a galvanometer mirror, may be used.

In the first aspect of the present invention described above, at least one of the frequency $f_p$ of the main scanning means, the natural frequency $f_m$ of the reflecting means and the subscanning interval L are set so that either the following first condition or second condition is satisfied. Therefore, the occurrence of a beat between the vibration of the main scanning means and the natural vibration of the reflecting means can be prevented. Accordingly, generation of jitter in the reflecting means due to the vibration of the main scanning means can be prevented. Further, the signal outputting means appropriately outputs the predetermined signal to the light source control means, and exposure can reliably begin from the start-of-main-scan point on the photosensitive material.

First condition:

$n'f_p-C1<f_m<n'f_p+C1$

Second condition:

$n'f_p+C2<f_m$ when $f_m<n'f_p$ $n'f_p-C2>f_m$ when $f_m<n'f_p$

In the second aspect of the present invention, at least one of the frequency $f_p$, the natural frequency $f_m$ , and the subscanning interval L is set so that a spatial frequency A of image light-to-dark contrast on a photosensitive material, which image light-to-dark contrast is caused by vibration of the main scanning means and natural vibration of the reflecting means and which spatial frequency A is obtained from following formula (15) is one of: a value which is less than a minimum value of spatial frequencies of a region in which image light-to-dark contrast on the photosensitive material is visible, the image light-to-dark contrast being caused by vibration of the main scanning means and natural vibration of the reflecting means, the region in which the image light-to-dark contrast is visible being obtained from a visibility curve which expresses a relation between spatial frequencies of the image light-to-dark contrast and density differences of the image light-to-dark contrast; and a value greater than a maximum value of the spatial frequencies of the region in which image light-to-dark contrast on the photosensitive material is visible. Therefore, formula (4) or formula (5) is satisfied, and image irregularities are not perceived in the image on the photosensitive material.

$$A=|f_m-n'f_p|/(L'f_p) \quad (15)$$

What is claimed is:

1. An exposure device comprising:

a light source which emits a light beam;

main scanning means for main scanning the light beam emitted from said light source by deflecting the light beam in a main scanning direction, said main scanning means vibrating at a frequency $f_p$;

imaging means for imaging, on a photosensitive material, the light beam deflected by said main scanning means;

subscanning means for moving the light beam and the photosensitive material relative to one another to subscan the light beam such that a subscanning interval is L;

signal outputting means for outputting a predetermined signal when a light beam, which is deflected by said main scanning means and which corresponds to a point outside of an image region on the photosensitive material, is incident on said signal outputting means, a natural frequency of said signal outputting means being $f_m$; and light source control means for controlling said light source on the basis of said signal such that the light beam is main-scanned from a start-of-main-scan point, wherein at least one of said frequency $f_p$, said natural frequency $f_m$, and said subscanning interval L is set such that one of the following first condition and second condition is satisfied:

first condition:

$n'f_p-C1<f_m<n'f_p+C1$ second condition:

$n'f_p+C2<f_m$ when $f_m \geqq n'f_p$ $n'f_p-C2>f_m$ when $f_m<n'f_p$ wherein $\alpha 1$ is a minimum value of spatial frequencies in a region in which image light-to-dark contrast is visible, the image light-to-dark contrast being generated on the photosensitive material by vibration of said main scanning means and natural vibration of said signal outputting means, the region in which the image light-to-dark contrast is visible being obtained from a visibility curve which expresses a relation between spatial frequencies of the image light-to-dark contrast and density differences of the image light-to-dark contrast; $\alpha 2$ is a maximum value of the spatial frequencies in the region in which the image light-to-dark contrast is visible; C1 is a value determined by said minimum value $\alpha 1$, said frequency $f_p$, and said subscanning interval L; C2 is a value determined by said maximum value $\alpha 2$, said frequency $f_p$, and said subscanning interval L; and n is an integer.

2. An exposure device according to claim 1, wherein C1 is a product of said minimum value $\alpha 1$, said frequency $f_p$, and said subscanning interval L, and C2 is a product of said maximum value $\alpha 2$, said frequency $f_p$, and said subscanning interval L.

3. An exposure device according to claim 1, wherein said main scanning means includes a polygon mirror which rotates at a rotational speed of $f_p$.

4. An exposure device according to claim 1, wherein said main scanning means includes a mirror which moves reciprocally at a frequency $f_p$.

5. An exposure device comprising:

a light source which emits a light beam;

main scanning means for main scanning the light beam emitted from said light source by deflecting the light beam in a main scanning direction, said main scanning means vibrating at a frequency $f_p$;

imaging means for imaging, on a photosensitive material, the light beam deflected by said main scanning means;

subscanning means for moving the light beam and the photosensitive material relative to one another to subscan the light beam such that a subscanning interval is L;

reflecting means for reflecting a light beam which is deflected by said main scanning means and which corresponds to a point outside of an image region on the photosensitive material, a natural frequency of said reflecting means being $f_m$;

signal outputting means for outputting a predetermined signal when the light beam reflected from said reflecting means is incident on said signal outputting means; and light source control means for controlling said light source on the basis of said signal such that the light beam is main-scanned from a start-of-main-scan point, wherein at least one of said Frequency $f_p$, said natural frequency $f_m$, and said subscanning interval L is set such that one of the following first condition and second condition is satisfied:

first condition:

$n'f_p-C1<f_m<n'f_p+C1$ second condition:

$n'f_p+C2<f_m$ when $f_m \geqq n'f_p$ $n'f_p-C2>f_m$ when $f_m<n'f_p$ wherein $\alpha 1$ is a minimum value of spatial frequencies in a region in which image light-to-dark contrast is visible, the image light-to-dark contrast being generated on the photosensitive material by vibration of said main scanning means and natural vibration of said reflecting means, the region in which the image light-to-dark contrast is visible being obtained from a visibility curve which expresses a relation between spatial frequencies of the image light-to-dark contrast and density differences of the image light-to-dark contrast; $\alpha 2$ is a maximum value of the spatial frequencies in the region in which the image light-to-dark contrast is visible; C1 is a value determined by said minimum value $\alpha 1$, said frequency $f_p$, and said subscanning interval L; C2 is a value determined by said maximum value $\alpha 2$, said frequency $f_p$, and said subscanning interval L; and n is an integer.

6. An exposure device according to claim 5, wherein C1 is a product of said minimum value $\alpha 1$, said frequency $f_p$, and said subscanning interval L, and C2 is a product of said maximum value $\alpha 2$, said frequency $f_p$, and said subscanning interval L.

7. An exposure device according to claim 5, wherein said main scanning means includes a polygon mirror which rotates at a rotational speed of $f_p$.

8. An exposure device according to claim 5, wherein said main scanning means includes a mirror which moves reciprocally at a frequency $f_p$.

9. An exposure device comprising:

a light source which emits a light beam;

main scanning means for main scanning the light beam emitted from said light source by deflecting the light beam in a main scanning direction, said main scanning means vibrating at a frequency $f_p$;

imaging means for imaging, on a photosensitive material, the light beam deflected by said main scanning means;

subscanning means for moving the light beam and the photosensitive material relative to one another to subscan the light beam such that a subscanning interval is L;

signal outputting means for outputting a predetermined signal when a light beam, which is deflected by said main scanning means and which corresponds to a point outside of an image region on the photosensitive material, is incident on said signal outputting means, a natural frequency of said signal outputting means being $f_m$; and light source control means for controlling said light source on the basis of said signal such that the light beam is main-scanned from a start-of-main-scan point, wherein at least one of said frequency $f_p$, said natural frequency $f_m$, and said subscanning interval L is set so that a spatial frequency A of image light-to-dark contrast on a photosensitive material, which image light-to-dark contrast is caused by vibration of said main scanning means and natural vibration of said signal outputting means and which spatial frequency A is obtained from following formula in which n is an integer, is one of a value which is less than a minimum value of spatial frequencies of a region in which image light-to-dark contrast on the photosensitive material is visible, the image light-to-dark contrast being caused by vibration of said main scanning means and natural vibration of said signal outputting means, the region in which the image light-to-dark contrast is visible being obtained from a visibility curve which expresses a relation between spatial frequencies of the image light-to-dark contrast and density differences of the image light-to-dark contrast, and a value greater than a maximum value of the spatial frequencies of the region in which image light-to-dark contrast on the photosensitive material is visible $A=|f_m-n'f_p|/(L'f_p)$.

10. An exposure device according to claim 9, wherein said main scanning means is structured so as to include a polygon mirror having a number $n_p$ of reflecting surfaces and rotating at rotational speed $f_p$, and the denominator of formula for A is $L'n_p'f_p$.

11. An exposure device according to claim 9, wherein said main scanning means includes a mirror which moves reciprocally at a frequency $f_p$.

12. An exposure device comprising:

a light source which emits a light beam;

main scanning means for main scanning the light beam emitted from said light source by deflecting the light beam in a main scanning direction, said main scanning means vibrating at a frequency $f_p$;

imaging means for imaging, on a photosensitive material, the light beam deflected by said main scanning means;

subscanning means for moving the light beam and the photosensitive material relative to one another to subscan the light beam such that a subscanning interval is L;

reflecting means for reflecting a light beam which is deflected by said main scanning means and which corresponds to a point outside of an image region on the photosensitive material, a natural frequency of said reflecting means being $f_m$;

signal outputting means for outputting a predetermined signal when the light beam reflected from said reflecting means is incident on said signal outputting means; and light source control means for controlling said light source on the basis of said signal such that the light beam is main-scanned from a start-of-main-scan point, wherein at least one of said frequency $f_p$, said natural frequency $f_m$, and said subscanning interval L is set so that a spatial frequency A of image light-to-dark contrast on a photosensitive material, which image light-to-dark contrast is caused by vibration of said main scanning means and natural vibration of said reflecting means and which spatial frequency A is obtained from following formula in which n is an integer, is one of a value which is less than a minimum value of spatial frequencies of a region in which image light-to-dark contrast on the photosensitive material is visible, the image light-to-dark contrast being caused by vibration of said main scanning means and natural vibration of said reflecting means, the region in which the image light-to-dark contrast is visible being obtained from a visibility curve which expresses a relation between spatial frequencies of the image light-to-dark contrast and density differences of the image light-to-dark contrast, and a value greater than a maximum value of the spatial frequencies of the region in which image light-to-dark contrast on the photosensitive material is visible $A=|f_m-n'f_p|/(L'f_p)$.

13. An exposure device according to claim 12, wherein said main scanning means is structured so as to include a polygon mirror having a number $n_p$ of reflecting surfaces and rotating at rotational speed $f_p$, and the denominator of formula for A is $L'n_p'f_p$.

14. An exposure device according to claim 12, wherein said main scanning means includes a mirror which moves reciprocally at a frequency $f_p$.

* * * * *